US005945374A

United States Patent [19]

Burns et al.

[11] Patent Number: 5,945,374

[45] Date of Patent: Aug. 31, 1999

[54] THERMAL DYE TRANSFER SYSTEM WITH RECEIVER CONTAINING ACIDIC SALTS

[75] Inventors: Elizabeth G. Burns; Steven Evans; Kristine B. Lawrence; Richard C. VanHanehem, all of Rochester, N.Y.

[73] Assignee: Eastman Kodak Company, Rochester, N.Y.

[21] Appl. No.: 08/995,689

[22] Filed: Dec. 22, 1997

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 5,523,274 6/1996 Shuttleworth et al. ..... 503/227
5,534,479 7/1996 Shuttleworth et al. ..... 503/227

FOREIGN PATENT DOCUMENTS 05238174 9/1993 Japan .

*Primary Examiner*—Bruce H. Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye being:

I) an electrically neutral, deprotonated, delocalized cationic dye precursor;

II) a pendant basic dye of the formula D-(L-E)$_m$ wherein D represents the residue of a dye, L represents a covalent linking group, E represents a moiety with basic properties and m is an integer of 1–3; or III) a cationic dye precursor having the following structure:

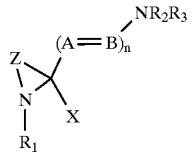

and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising an acidic salt formed from the reaction of a weak, nitrogen-containing base with a strong protic acid dissolved or dispersed in a polymeric binder.

8 Claims, No Drawings

THERMAL DYE TRANSFER SYSTEM WITH RECEIVER CONTAINING ACIDIC SALTS

FIELD OF THE INVENTION

This invention relates to the use of an acidic dye-receiving element for thermal dye transfer imaging comprising an acidic salt derived from a weak, nitrogen-containing base and a strong protic acid which is capable of protonating a variety of thermally transferred basic dyes.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

There is a need to provide thermal dye transfer imaging systems that yield images which are resistant to degradation by contact with other surfaces, chemicals, fingerprints, etc. Such image degradation is often the result of continued migration of the transferred dyes after the printing step.

One approach to reducing the continued migration of the transferred dyes is to utilize basic dyes which are capable of reacting with acidic substances in the receiving element to form migration-resistant cationic dye salts. However, it is difficult to effectively protonate a thermally transferred basic dye in a hydrophobic, polymeric receiving element with a conventional, electrically neutral acidic substance because the polymeric medium provides little stabilization of the charged dye salt that is formed.

One way to overcome this is to use a very strong protic acid such as a sulfonic acid. However, strong protic acids can have deleterious effects on many polymeric materials and often induce unwanted color shifts of the transferred dyes.

DESCRIPTION OF RELATED ART

Japanese Patent Application JP/05-238174 describes the thermal transfer of pendant basic dyes of the formula A-(L-B)$_n$ to receiving elements containing acidic materials.

A represents the residue of a dye, L represents a covalent linking group, B represents a basic substituent and n is an integer of 1–3. The preferred acidic materials are phenols and carboxylic acids. However, there is a problem with the acidic receiving elements described in this reference in that they do not effectively protonate and bind thermally transferred basic dyes, as will be shown below.

U.S. Pat. Nos. 5,523,274 and 5,534,479 describe the use of receiving elements comprising polymers substituted with strongly acidic groups such as sulfonic acids. There is a problem with these receiving elements in that typical pendant basic azo dyes, such as Dyes 10 and 11 below, were found to undergo varying amounts of protonation at the azo group in addition to the desired protonation on the pendant amino group in such strongly acidic environments. This "over protonation" causes variable and undesirable color shifts.

It is the object of this invention to provide an assemblage comprising a dye-receiver containing an acidic substance which is effective at protonating a wide variety of basic dyes without degrading the transferred dye color or the polymeric receiving layers.

SUMMARY OF THE INVENTION

This and other objects are achieved in accordance with this invention which relates to a thermal dye transfer assemblage comprising:

(a) a dye-donor element comprising a support having thereon a dye layer comprising a dye dispersed in a polymeric binder, the dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

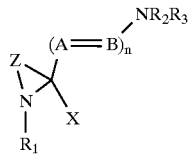

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising an acidic salt formed from the reaction of a weak, nitrogen-containing base with a strong protic acid dissolved or dispersed in a polymeric binder.

DESCRIPTION OF THE PREFERRED EMBODIMENTS

It was found that dye-receiving elements comprising salts derived from weak, nitrogen-containing bases and strong acids ($B^1H^+Y^-$) are surprisingly effective at protonating and binding thermally transferred basic dyes. They are much more effective than electrically neutral acidic materials with similar aqueous pKa's.

It is believed that this happens because the reaction of the ionic acidic materials of the invention with the thermally transferred basic dyes is isoelectric, that is, there is no net change in charge during the reaction:

$$B^1H^+Y^-+Dye \leftrightharpoons B^1+DyeH^++Y^-$$

The charge on the ionic salt of the invention is simply transferred to the dye salt during the protonation reaction as it is generated. In such isoelectric processes, solvation effects of the surrounding medium are minimized and as long as the dye is more basic than the weak base, $B^1$, the reaction will proceed as written.

In contrast, when electrically neutral acidic materials are used as described in the prior art, a cationic dye salt is generated from two neutral components:

$$HY+Dye \leftrightharpoons DyeH^++Y^-$$

The degree to which the surrounding medium is able to stabilize the developing charge on the dye salt will be important in determining the extent of the reaction. Most useful polymeric receiving layers for use in thermal transfer imaging are hydrophobic and are not effective at stabilizing charged species so that the protonation will be difficult to achieve.

In a preferred embodiment of the invention, the acidic salts are derived from weak, nitrogen-containing bases and strong protic acids and have the formula $(B^1H^+)_nY^{-n}$, wherein:

$B^1H^+$ represents the protonated form of a basic, nitrogen-containing moiety ($B^1$) having an aqueous pKa of from about 0 to 10, preferably from about 1 to 7;

$Y^{-n}$ represents the mono- or polyvalent conjugate anion of a strong organic or inorganic protic acid;

n represents an integer from 1 to 3;

when n is greater than 1, each $B^1H^+$ may be the same or different;

$B^1$ and Y may be separate or joined together; and either or both of $B^1$ and Y may be joined to a polymeric chain.

The aqueous pKa values for many nitrogen-containing compounds are tabulated in chemistry reference texts, such as *Lange's Handbook* of *Chemistry*, $11^{th}$ ed., John A. Dean, ed., McGraw-Hill, 1972 (pp. 5–13 to 5–39) and *The CRC Handbook of Chemistry and Physics*, $69^{th}$ ed., R. C. Weast, editor-in-chief, CRC Press, 1988 (pp. D-159 to D-161). Also, a useful tabulation can be found in W. Huber, *Titrations in Non-Aqueous Solvents*, Academic Press, 1967 (pp. 215–229).

Examples of $B^1H^+$ within the scope of this invention and their aqueous pKa's include: anilinium (4.6), 3-chloroanilinium (3.3), N,N-diethylanilinium (pKa=6.6), imidazolium (7.0), trans-cyclohexanediammonium (6.3 and 9.7), N,N-diethyl-o-toluidinium (7.2), diethanolammonium (8.9), N,N-dimethylbenzylammonium (9.0), hydroxylammonium (6.0), 3-hydroxypyridinium (8.7), 4-tert-butylpyridinium (6.2), triethanolammonium (7.8), methoxyethylammonium (9.4), 4-methylimidazolium (7.4), N-methylmorpholinium (7.1), morpholinium (8.7), phenethylammonium (9.8), trimethylammonium (9.8), hydroxylammonium (6.0), phenazinium (1.2), pyrazinium (0.6), pyrazolium (2.5), semicarbazide(protonated cation) (3.4), urea(protonated cation), ammonium (9.2), thiourea (protonated cation) (2.0) and 2-chloropyridinium (0.7).

Examples of $Y^-$ include fluoride, chloride, bromide, iodide, nitrate, sulfate, oxalate, phosphate, perchlorate, fluoroborate, hexafluoroantimonate, trifluoroacetate, p-toluenesulfonate, p-bromobenzenesulfonate, naphthalenedisulfonate, and methanesulfonate.

Examples of acidic salts of the invention wherein $B^1$ and Y are joined together include sulfamic acid ($H_3N^+SO_3^-$, pKa=1.0), aminoethylsulfonic acid ($H_3N^+C_2H_4SO_3^-$, pKa=9.1), and sulfamic acid (pKa=3.1).

Example of acidic salts of the invention wherein $B^1$ or Y are joined to a polymer chain include poly(4-vinylpyridine) hydrochloride, poly(2-vinylpyridine) hydrochloride, chitosan hydrochloride and polyester ionomers containing units of the ammonium, pyridinium or anilinium salt of a sulfonic acid.

Typical acidic salts of the invention include urea sulfate, sulfamic acid and pyridinium p-toluenesulfonate (all available from the Aldrich Chemical Company) and p-nitroanilinium p-toluenesulfonate, prepared as described in Example 1 below.

The acidic ionic salts of the invention are dispersed or dissolved in a polymeric binder such as a polyester, a polyurethane, a polycarbonate, etc.; an addition polymer such as a polystyrene, a vinyl polymer, an acrylic polymer, etc.; or a block copolymer containing large segments of more than one type of polymer covalently linked together. In a preferred embodiment of the invention, an acrylic polymer, a styrene polymer or a vinyl polymer having a Tg of less than 19° C. is used.

Specific examples of binder polymers include:

Polymer 1
AQ29D
(Available from the Eastman Chemical Company)

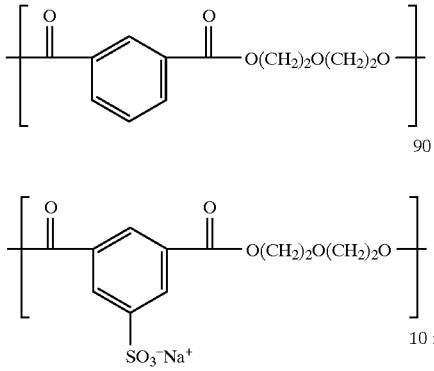

Polymer 2: poly(butyl acrylate-co-allyl methacrylate) (98:2) 90 wt. core/poly(glycidyl methacrylate) 10 wt. shell prepared by standard techniques, (Tg=−40° C.)

Polymer 3: Vylon 200® (Toyobo Co., Ltd.), a polyester similar to Vylon 280®, described in JP/05-238174, Example 1.

Polymer 4: poly(butyl acrylate-co-acrylamide) (90:10), prepared by standard methods.

Polymer 5: poly(butyl acrylate-co-allyl methacrylate) 98:2 wt core/poly(ethyl methacrylate) 30 wt shell, (Tg=−41° C.)

Polymer 6: poly(butyl acrylate-co-allyl methacrylate) 98:2 wt core/poly(2-hydroxypropyl methacrylate) 10 wt shell, (Tg=−40° C.)

Polymer 7: poly(butyl acrylate-co-ethylene glycol dimethacrylate) 98:2 wt core/poly(glycidyl methacrylate 10 wt shell, Tg=−42° C.)

Polymer 8: poly(butyl acrylate-co-allyl methacrylate-co-glycidyl methacrylate) 89:2:9 wt, (Tg=−34° C.)

Polymer 9: poly(butyl acrylate-co-ethylene glycol dimethacrylate-co-glycidyl methacrylate) 89:2:9 wt (Tg=−28° C.)

Polymer 10: poly(butyl methacrylate-co-butyl acrylate-co-allyl methacrylate) 49:49:2 wt core/poly(glycidyl methacrylate) 10 wt shell, (Tg=−18° C.)

Polymer 11: poly(methyl methacrylate-co-butyl acrylate-co-2-hydroxyethyl methacrylate-co-2-sulfoethyl methacrylate sodium salt) 30:50:10:10 wt, (Tg=−3° C.)

Polymer 12: poly(methyl methacrylate-co-butyl acrylate-co-2-hydroxyethyl methacrylate-co-styrene sulfonic acid sodium salt) 40:40:10:10 wt, (Tg=0° C.)

Polymer 13: poly(methyl methacrylate-co-butyl acrylate-co-2-sulfoethyl methacrylate sodium salt-co-ethylene glycol dimethacrylate) 44:44:10:2 wt, (Tg=14° C.)

Polymer 14: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

Polymer 15: XU31066.50 (experimental polymer based on a styrene butadiene copolymer from Dow Chemical Company) (Tg=−31 ° C.)

Polymer 16: AC540® nonionic emulsion (Allied Signal Co.) (Tg=−55° C.)

The above polymer in the dye image-receiving layer of the assemblage of the invention may be present in any amount which is effective for its intended purpose. In general, good results have been obtained at a concentration of from about 0.5 to about 10 g/m$^2$ and the polymers may be coated from organic solvents or water, if desired.

As noted above, there are three different types of dyes which may be employed in the dye-donor element of the assemblage of the invention. The first type of dye is an electrically neutral, deprotonated, delocalized cationic dye precursor. In a preferred embodiment of the invention, these dyes have the following formula:

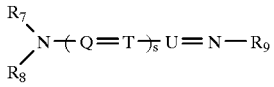

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 or an integer from 1 to 11.

Further examples of these dyes are found in U.S. Pat. Nos. 4,880,769; 5,534,478; and 5,559,076, the disclosures of which are hereby incorporated by reference. Specific examples of these dyes include the following which also have listed the absorption maxima of the deprotonated and protonated species, with the values for the latter shown in parentheses:

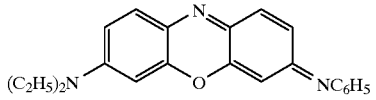

Dye 1
λ max 556 nm (641 nm)
magenta (cyan)

-continued

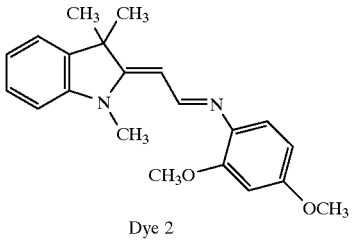

Dye 2
λ max 379 nm (405 nm)
yellow (yellow)

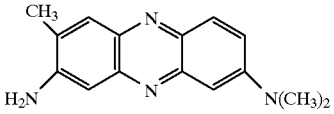

Dye 3
λ max 459 nm (536 nm)
yellow (magenta)

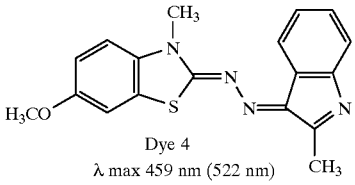

Dye 4
λ max 459 nm (522 nm)
yellow (magenta)

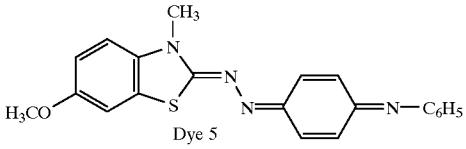

Dye 5
λ max 503 nm (621 nm)
red (blue)

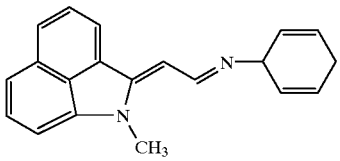

Dye 6
λ max 479 nm (513 nm)
yellow (magenta)

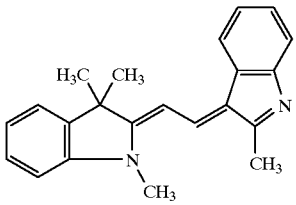

Dye 7
λ max 485 nm (495 nm)
orange (orange)

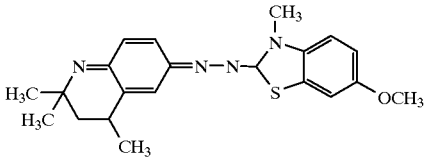

Dye 8
λ max 472 nm (601)
orange (blue)

-continued

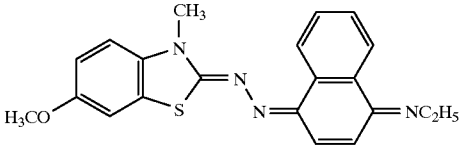

Dye 9
λ max 469 nm (618)
yellow (blue)

The second type of dye which may be employed in the dye-donor element of the assemblage of the invention has a pendant basic group as described above. Examples of these dyes are found in Japanese Patent Application J05/238174, the disclosure of which is hereby incorporated by reference. Specific examples of these dyes include the following:

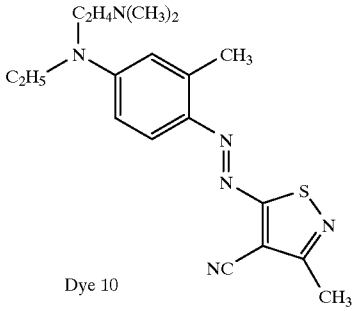

Dye 10

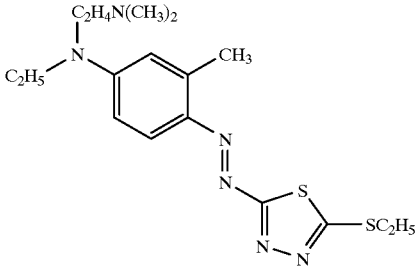

Dye 11

The third type of dye which may be employed in the dye-donor element of the assemblage of the invention is a cationic dye precursor as described above. In a preferred embodiment, this dye has the following formula:

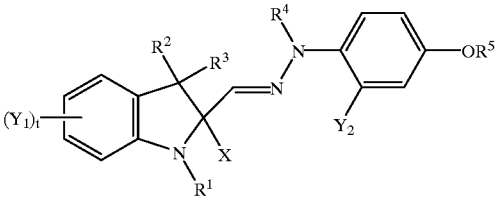

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —OCON(R)$_2$, —SO$_2$N(R)$_2$ or —NRCOOR; wherein each R independently represents H or R$^1$;

Y$_1$ and Y$_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and R$^1$ may be combined together with the atoms to which they are attached to form a 5–7 membered ring;

any two of Y$_1$ may be combined to form additional fused rings; and

R$^2$ and R$^3$ may be combined together to form a 5–7 membered ring.

Specific examples of these dyes include the following:

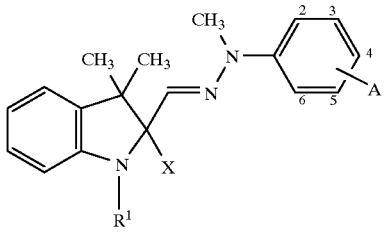

| Dye Precursor | R$^1$ | X | A | Molecular Weight | λmax (nm) (ε-max)[1] |
|---|---|---|---|---|---|
| 12 | CH$_3$ | OH | 4-OCH$_3$ | 339 | 449 (36,300) |
| 13 | —CH$_2$CH$_2$O— | | 4-OC$_6$H$_5$ | 413 | 444 (39,100) |
| 14 | —CH$_2$CH$_2$CONH— | | 2,4-(OCH$_3$)$_2$ | 408 | 426 (31,500) |
| 15 | —CH$_2$CH$_2$CONH— | | 4-OCH$_3$ | 378 | 455 (38,100) |
| 16 | —CH$_2$CH$_2$O— | | 4-OCH$_3$ | 351 | 455 (36,000) |
| 19 | —CH$_2$CH(CH$_2$OH)O— and —CH$_2$CH(OH)CH$_2$O— (mixture) | | 4-OC$_6$H$_5$ | 443 | 446 (38,900) |
| 17 | —CH$_2$CH(CH$_2$OH)O— and —CH$_2$CH(OH)CH$_2$O— (mixture) | | 2,4-(OCH$_3$)$_2$ | 411 | 422 (29,300) |
| 18 | —CH$_2$CH$_2$O— | | 4-OCH$_2$CONHCH$_3$ | 408 | 448 (38,100) |

[1]In ethanol containing HCl,
ε = molar absorbtivity

Further examples of these dyes are found in copending application Ser. No. 08/996,388, filed of even date herewith by Evans, Pyszczek and Weber, entitled Dye-Donor Element for Thermal Dye Transfer, (Docket 76728HEC).

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate, cellulose acetate propionate, cellulose acetate butyrate, cellulose triacetate, or any of the materials described in U. S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dyes as described above, and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Preparation of p-nitroanilinium p-toluenesulfonate

To a solution of 1.38 g (0.01 mole) p-nitroaniline in 10 mL of acetone was added a solution of p-toluenesulfonic acid (2.375 g, 0.0125 mole) in 10 mL of acetone at room temperature. After stirring for 1 hour at room temperature, the reaction mixture was cooled to 5° C. and the product was isolated by filtration. The yield was 2.49 g (80% of theory) of a pale yellow solid.

Example 2

Preparation of poly(4- and 2-vinylpyridine) hydrochloride

To a 20% aqueous solution of poly(4-vinylpyridine, MW=50,000, available from Scientific Polymer Products) was added aqueous hydrochloric acid in an amount equal to 25, 50 or 75% of the theoretical amount needed to fully neutralize the pyridine sites. The three different poly(4-vinylpyridine) hydrochloride solutions thus produced were labeled as P4VP-25, P4VP-50 and P4VP-75.

The above procedure was repeated using a 20% aqueous solution of poly(2-vinylpyridine) (MW=200,000), also available from Scientific Polymer Products. The three different poly(2-vinylpyridine) hydrochloride solutions thus produced were labeled as P2VP-25, P2VP-50 and P2VP-75.

Example 3

Preparation and Evaluation of Thermal Dye Transfer Images

Preparation of Dye-Receiving Elements.

Dye-receiving elements described below were prepared by first extrusion laminating a paper core with a 38 $\mu$m thick microvoided composite film (OPPalyte 350TW®, Mobil Chemical Co.) as disclosed in U.S. Pat. No. 5,244,861.

Control Dye-Receiving Element C-1: This receiving element is essentially as described in Example 1 of JP/05-238174.

The composite film side of the above laminate was then coated with the following layers in the order recited:

1) a subbing layer of 0.02 g/m$^2$ Polymin P® polyethyleneimine (BASF Corp.) coated from water; and
2) a dye-receiving layer composed of 7.23 g/m$^2$ of Polymer 3 (above), 0.72 g/m$^2$ of trichlorophenol (acidic substance I-12 of JP/05-238174, pKa=6.0) and 0.66 g/m$^2$ polyisocyanate (Desmodour N3300®, Mobay Corp.) coated from toluene, MEK and cyclohexanone (46/46/8).

Control Dye Receiving Element C-2:

This receiving element is essentially that described as Receiver 1 in U.S. Pat. No. 5,534,479 and was prepared as described above for Control Dye-Receiving Element 1, except the dye-receiving layer was composed of 6.73 g/m$^2$ of poly(butyl acrylate-co-2-acrylamido-2-methylpropanesulfonic acid) (70/30 wt. ratio), similar to Receiver 1 of U.S. Pat. No. 5,534,479, coated from methanol.

Dye-Receiving Elements I-1 to I-14 and C-3 to C-8:

These receiving elements were prepared as described above for Control Receiving Element C-1, except the subbing layer comprised a mixture of Prosil ® 221, aminopropyl-triethoxysilane, and Prosil ® 2210, an amino-functional epoxysilane, (0.05 g/m$^2$ each, both available from PCR, Inc.) coated from 3A alcohol, the dye-receiving layer was composed of a binder polymer (see Table 1 for details), a control acidic material or ionic acidic salt of the invention (see Table 1 for details) and a fluorocarbon surfactant (Fluorad FC-170 ®, 3M Corporation, 0.022 g/m$^2$) coated from water.

When Polymer 1 was used as the binder polymer, SynFac 8216®, a nonionic aryl polyoxyethylene ether surfactant available from Milliken Chemicals at 1.08 g/m$^2$ was also added to improve coating quality. The levels of the acidic material were adjusted based on their equivalent weights or analyzed acid content so that the acid level in each receiving element would be similar. The levels of binder polymer were adjusted to yield a total coated thickness of 6.73 g/m$^2$ Details of the receiving element compositions are listed in the following table:

TABLE 1

| Receiving Element | Acidic Material (g/m$^2$) | Binder Polymer (g/m$^2$) |
|---|---|---|
| I-1 | urea sulfate (Aldrich Chemical Co.) (0.23) | 1* (5.42) |
| I-2 | pyridinium tosylate (Aldrich Chemical Co.) (0.26) | 1* (5.39) |
| I-3 | p-nitroanilinium p-toluenesulfonate (0.32) | 1* (5.33) |
| I-4 | urea sulfate (Aldrich Chemical Co.) (0.23) | 2 (6.50) |
| I-5 | pyridinium tosylate (Aldrich Chemical Co.) (0.26) | 2 (6.47) |
| I-6 | p-nitroanilinium p-toluenesulfonate (0.32) | 2 (6.41) |
| I-7 | P4VP-25 (2.17) | 4 (4.56) |
| I-8 | P4VP-50 (1.03) | 4 (5.70) |
| I-9 | P4VP-75 (0.64) | 4 (6.09) |
| I-10 | P2VP-25 (2.17) | 4 (4.56) |
| I-11 | P2VP-50 (1.03) | 4 (5.70) |
| I-12 | P2VP-75 (0.64) | 4 (6.09) |
| I-13 | urea nitrate (0.22) | 2 (6.51) |
| I-14 | sulfamic acid (0.17) | 2 (6.56) |

TABLE 1-continued

| Receiving Element | Acidic Material ($g/m^2$) | Binder Polymer ($g/m^2$) |
|---|---|---|
| C-3 | none | 1* (5.65) |
| C-4 | sulfuric acid (0.1) | 1* (5.55) |
| C-5 | hexanoic acid (0.12) | 1* (5.53) |
| C-6 | none | 2 (6.73) |
| C-7 | sulfuric acid (0.1) | 2 (6.63) |
| C-8 | hexanoic acid (0.12) | 2 (6.61) |

*Coating also contains 1.08 $g/m^2$ SynFac 8216 ®

Preparation of Dye-donor Elements.

Dye-donor elements were prepared by coating the compositions described below in the order listed on a 6 mm poly(ethylene terephthalate) support;

Dye-donor element 1A:

1) a subbing layer of Tyzor TBT®, a titanium tetrabutoxide available from DuPont (0.16 $g/m^2$) coated from 1-butanol; and 2) a dye layer containing Dye 1 above (0.16 $g/m^2$), a mixture of cellulose acetate propionates 482-0.5 and 482-20 (0.086 $g/m^2$ each, available from the Eastman Chemical Company), poly(butyl methacrylate-co-Zonyl TM®) 75:25, (0.043 $g/m^2$) where Zonyl TM® is a fluorinated acrylate monomer available from DuPont and Paraplex G25® (a polyester sebacate available from C. P. Hall Company) (0.022 $g/m^2$) coated from a mixture of toluene, methanol, and cyclohexanone (70:25:5).

Dye-donor element 1B:

1) a subbing layer of 0.043 $gm^2$ Polymin P® polyethyleneimine (BASF Corp.) and poly(butyl acrylate-co-allyl methacrylate) (98:2) 70 wt. core/poly(glycidyl methacrylate) 30 wt. shell (0.011 $g/m^2$) coated from water; (this subbing layer is claimed in U.S. Pat. No. 5,834,399) and 2) a dye layer containing Dye 1 (0.152 $g/m^2$), FC-431® fluorocarbon surfactant (3M Company) (0.01 $g/m^2$) and poly(vinyl butyral) (Butvar B76®, Monsanto Company, 0.304 $g/m^2$) coated from a toluene, n-propanol, cyclohexanone (65:30:5) solution:

Dye-donor element 2: was prepared as described for Dye-donor Element 1A, except the dye layer contained 0.28 $g/m^2$ Dye 2, 0.126 $g/m^2$ each of cellulose acetate propionates 482-0.5 and 482-20, 0.068 $g/m^2$ of poly(butyl methacrylate-co-Zonyl TM®), 0.011 $g/m^2$ Paraplex G25® and 0.011 $g/m^2$ of the 2,4,6-trimethylanilide of phenylindandicarboxylic acid (CAS Reg. No. 156081-22-0).

Dye-donor element 3A: was prepared as described for Dye-donor Element 1A, except the dye layer contained 0.204 $g/m^2$ Dye 10, 0.106 $g/m^2$ each of cellulose acetate propionates 482-0.5 and 482-20, 0.061 $g/m^2$ of poly(butyl methacrylate-co-Zonyl TM®), 0.022 $g/m^2$ Paraplex G25® and 0.011 $g/m^2$ of CAS Reg. No. 156081-22-0.

Dye-donor element 3B: was prepared as described for dye-donor element 1B, except the dye layer contained Dye 10 (above, 0.213 $g_m{}^2$) and 0.426 $g/m^2$ Butvar B-76®.

Dye-donor element 5: was prepared as described for dye-donor element 1B, except the dye layer contained Dye 11 (above, 0.228 $g/m^2$) and 0.456 $g/m^2$ Butvar B-76®.

Dye-donor element 6: was prepared as described for dye-donor element 1B, except the dye layer contained Dye 13 (above, 0.327 $g/m^2$) and 0.654 $g/m^2$ Butvar B-76®.

On the back side of the above dye-donor elements were coated the following compositions in the order listed:

1) a subbing layer of Tyzor TBT®, a titanium tetrabutoxide, (DuPont Co.) (0.16 $g/m^2$) coated from 1-butanol; and 2) a slipping layer of poly(vinyl acetal), (Sekisui, 0.38 $g/m^2$), candellila wax (7% dispersion in methanol, 0.022 $g/m^2$), an amino-terminated poly (dimethylsiloxane), (Huels, 0.011 $g/m^2$) and p-toluenesulfonic acid (0.0003 $g/m^2$) coated from a mixture of 3-pentanone and water (98:2).

Preparation and Evaluation of Thermal Transfer Images.

Eleven-step sensitometric thermal dye transfer images were prepared from the above dye-donor and receiving elements. The dye side of a portion of a dye-donor element approximately 10 cm ×15 cm in area was placed in contact with a receiving-layer side of a receiving element of the same area. This assemblage was clamped to a stepper motor-driven, 60 mm diameter rubber roller. A thermal head (TDK No. 8I0625, thermostatted at 25° C.) was pressed with a force of 24.4 Newton (2.5 kg) against the donor element side of the assemblage, pushing it against the rubber roller.

The imaging electronics were activated causing the donor-receiving assemblage to be drawn through the printing head/roller nip at 40.3 mm/sec. Coincidentally, the resistive elements in the thermal print head were pulsed for 127.75 $\mu$s at 130.75 $\mu$s intervals during a 4.575 msec/dot printing cycle (including a 0.391 msec/dot cool down interval). A stepped image density was generated by incrementally increasing the number of pulses/dot from a minimum of 0 to a maximum of 32 pulses/dot. Two printing conditions were employed depending on the dye-donor composition. In printing condition A the voltage supplied to the thermal head was approximately 13 v, resulting in an instantaneous peak power of 0.318 watts/dot and a maximum total energy of 1.30 mJ/dot. For printing condition B, the voltage supplied to the thermal head was 14 v, resulting in an instantaneous peak power of 0.369 watts/dot and a maximum total energy of 1.51 mJ/dot. Print room humidity: 48% RH.

After printing, the imaged receiving element was separated from the donor element and placed into an oven at 50° C./50% RH for 3 hours to ensure that the dye was evenly distributed throughout the receiving layer. After incubation, the appropriate Status A reflection densities (red, green or blue) of each of the eleven steps were measured with an X-Rite 820 reflection densitometer. In each of Tables 3 to 6 the density values measured at step number 10 or 11 (a measure of the efficiency of dye transfer) for each donor: receiving element assemblage are listed.

Dye 1 is magenta in its unprotonated state and cyan when protonated. The degree of protonation of Dye 1 is measured by the ratio of the Status A red and green densities. Higher values indicate a greater degree of protonation. This parameter is included in Table 3.

Dyes 2 and 13 do not absorb strongly in the visible spectrum in their unprotonated forms. The Status A Blue density of the transferred image should correlate with the degree of protonation but can be confounded with the transfer efficiency of the dye. As another measure of degree of protonation for Dyes 2 and 13, the imaged receiving elements were suspended in a closed vessel above a small volume of concentrated hydrochloric acid (HCl) for 1 minute. The Status A blue density of Step 11 was reread as above and the percentage (%) increase in density observed is listed in Tables 4 and 7. Higher numbers reflect less protonated dye in the original (unfumed) imaged receiving element.

Dyes 10 and 11 are magenta, but are prone to variable and undesirable color shifts due to protonation on the azo linkage in the presence of strong acids. The purity of the colors of Dyes 10 and 11 is measured by the ratio of the Status A green and red densities. This value is also reported in Tables 5 and 6. Low values indicate undesirable color shifts due to protonation on the azo linkage.

The imaged side of the stepped image was then placed in intimate contact with a similarly sized piece of a plasticized poly(vinyl chloride) (PVC) report cover, a 1 kg weight was placed on top and the whole assemblage was placed into an oven held at 50° C. for 1 week. The PVC sheet was separated from the stepped image. The appropriate Status A transmission density in the PVC (a measure of the amount of unwanted dye migration into the PVC) corresponding to the maximum density step in the stepped image was measured with an X-Rite 820 reflection densitometer. The retransfer densities for each donor: receiving element assemblage are also listed in Tables 2 to 6. Low numbers indicate effective binding of the dye to the receiving element.

TABLE 2

Performance Data for Dye 1

| Dye-donor Element* | Dye-Receiving Element | Step 10 Reflection Density (Status A Red) | Retransfer Density (Status A Red) | Dye Hue Status A R/G Ratio |
|---|---|---|---|---|
| 1A | I-1 | 2.8 | 0.02 | 5.8 |
| 1A | I-2 | 2.7 | 0.06 | 5.7 |
| 1A | I-3 | 2.7 | 0.07 | 5.7 |
| 1A | I-4 | 2.3 | 0.03 | 4.3 |
| 1A | I-5 | 2.1 | 0.07 | 4.5 |
| 1A | I-7 | 1.6 | 0.20 | 5.0 |
| 1A | I-8 | 1.9 | 0.25 | 4.3 |
| 1A | I-9 | 1.7 | 0.09 | 4.2 |
| 1A | I-10 | 1.8 | 0.17 | 5.0 |
| 1A | I-13 | 2.1 | 0.11 | 4.5 |
| 1A | 1-14 | 2.3 | 0.03 | 4.5 |
| 1A | I-11 | 1.7 | 0.08 | 4.4 |
| 1A | I-12 | 2.0 | 0.09 | 4.2 |
| 1B (printing condition B) | C-1 | 0.5** | 0.53 | 0.4 |
| 1A | C-3 | 1.2** | 0.44 | 1.2 |
| 1A | C-5 | 1.8*** | 0.38 | 1.4 |
| 1A | C-6 | 1.0** | 0.4 | 0.8 |
| 1A | C-8 | 1.0** | 0.21 | 0.8 |

*Printing condition A except as noted
**Purple-magenta colored image
***Reddish-blue colored image The data in Table 2 demonstrate that the receiving elements of the invention effectively protonate (high R/G ratio) and bind (low retransfer density) Dye 1, a deprotonated delocalized cationic dye. Receiving elements containing acidic substances of the related art that are not ionic salts (C-1, C-5 and C-8) do not protonate and bind Dye 1.

TABLE 3

Performance Data for Dye 2
(Dye-donor Element 2, Printing condition A)

| Dye-Receiving Element | Step 11 Reflection Density (Status A Blue) | Retransfer Density (Status A Blue) | % Change in Density After Fuming with HCl (Status A Blue) |
|---|---|---|---|
| I-1 | 2.5 | 0.01 | 1 |
| I-2 | 2.8 | 0.15 | 0 |

TABLE 3-continued

Performance Data for Dye 2
(Dye-donor Element 2, Printing condition A)

| Dye-Receiving Element | Step 11 Reflection Density (Status A Blue) | Retransfer Density (Status A Blue) | % Change in Density After Fuming with HCl (Status A Blue) |
|---|---|---|---|
| I-3 | 2.1 | 0.11 | 1 |
| I-4 | 2.0 | 0.01 | 1 |
| I-5 | 2.2 | 0.11 | 1 |
| I-6 | 1.7 | 0.12 | 0 |
| C-1 | 0.6 | 0.07 | 183 |
| C-3 | 1.4 | 0.07 | 76 |
| C-5 | 1.7 | 0.08 | 13 |
| C-6 | 0.7 | 0.04 | 48 |
| C-8 | 0.6 | 0.04 | 58 |

The data in Table 3 demonstrate that the receiving elements of the invention effectively protonate (high Status A blue density, no change upon exposure to acid fumes) and bind (low retransfer density) Dye 2, a deprotonated delocalized cationic dye. Receiving elements containing acidic substances of the related art that are not ionic salts (C-1, C-5 and C-8) do not protonate Dye 1 effectively (large % change in density after fuming with HCl).

TABLE 4

Performance Data for Dye 10

| Dye-donor Element* | Dye-Receiving Element | Step 11 Reflection Density (Status A Green) | Retransfer Density (Status A Green) | Dye Hue Status A G/R Ratio |
|---|---|---|---|---|
| 3A | I-1 | 2.3 | 0.02 | 6.2 |
| 3A | I-2 | 2.9 | 0.05 | 6.7 |
| 3A | I-3 | 1.8 | 0.04 | 6.1 |
| 3A | I-4 | 2.2 | 0.01 | 8.8 |
| 3A | I-5 | 2.2 | 0.07 | 9.0 |
| 3A | I-6 | 1.7 | 0.02 | 8.2 |
| 3B (printing condition B) | C-1 | 1.0 | 0.38 | 5.6 |
| 3B (printing condition B) | C-2 | 1.0** | 0.03 | 2.4 |
| 3A | C-3 | 2.6 | 1.0 | 4.1 |
| 3A | C-5 | 2.8 | 0.94 | 4.5 |
| 3A | C-6 | 2.4 | 0.35 | 9.0 |
| 3A | C-8 | 2.4 | 0.36 | 9.4 |

*Printing condition A except as noted
**Reddish-brown colored image

The data in Table 4 demonstrate that the receiving elements of the invention effectively protonate (high G/R ratio) and bind (low retransfer density) Dye 10, a pendant basic-substituted dye. Receiving elements containing acidic substances of the related art that are not ionic salts (C-1, C-5 and C-8) do not effectively bind Dye 10 (high retransfer density) and strongly acidic receiving elements such as C-2 lead to unwanted color shifts (low G/R ratio).

TABLE 5

Performance Data for Dye 11
(Dye-donor Element 5, Printing Condition A)

| Dye-Receiving Element | Step 11 Reflection Density (Status A Green) | Retransfer Density (Status A Green) | Dye Hue Status A G/R Ratio |
|---|---|---|---|
| I-1 | 1.2 | 0.03 | 9.6 |
| I-2 | 2.0 | 0.05 | 17.5 |
| I-3 | 1.8 | 0.05 | 13.7 |
| I-4 | 1.6 | 0.02 | 13.0 |
| I-5 | 1.5 | 0.03 | 14.6 |
| C-1 | 1.4 | 0.30 | 17.2 |
| C-3 | 2.3 | 0.52 | 13.9 |
| C-4 | 2.0* | 0.02 | 5.9 |
| C-5 | 2.1 | 0.53 | 17.3 |
| C-6 | 1.4 | 0.19 | 15.7 |
| C-7 | 1.6* | 0.02 | 6.7 |
| C-8 | 0.9 | 0.17 | 13.3 |

*reddish-brown colored image

The data in Table 5 demonstrate that the receiving elements of the invention effectively protonate (high G/R ratio) and bind (low retransfer density) Dye 11, a pendant basic-substituted dye. Receiving elements containing acidic substances of the related art that are not ionic salts (C-1, C-5 and C-8) do not effectively bind Dye 11 (high retransfer density) and strongly acidic receiving elements such as C-4 and C-7 lead to unwanted color shifts (low G/R ratio).

TABLE 6

Performance Data for Dye 13
(Dye-donor Element 6, Printing Condition A)

| Dye-Receiving Element | Step 10 Reflection Density (Status A Blue) | Retransfer Density (Status A Blue) | % Change in Density After Fuming with HCl (Status A Blue) |
|---|---|---|---|
| I-1 | 2.0 | 0.01 | 0 |
| I-2 | 1.9 | 0.04 | 0 |
| I-3 | 1.5 | 0.03 | 0 |
| I-4 | 1.8 | 0.02 | 0 |
| I-5 | 2.0 | 0.03 | 0 |
| C-1 | 0.3 | 0.01 | 300 |
| C-3 | 0.8 | 0.19 | 125 |
| C-5 | 1.3 | 0.16 | 28 |
| C-6 | 0.8 | 0.11 | 33 |
| C-8 | 0.7 | 0.12 | 50 |

The data in Table 6 demonstrate that the receiving elements of the invention effectively protonate (high Status A blue density, no change upon exposure to acid fumes) and bind (low retransfer density) Dye 13, a cationic dye precursor. Receiving elements containing acidic substances of the related art that are not ionic salts (C-1, C-5 and C-8) do not protonate (large % change in density after fuming with HCl) and bind Dye 13 effectively (high retransfer density).

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

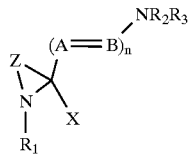

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer comprising an acidic salt formed from the reaction of a weak, nitrogen-containing base with a strong protic acid dissolved or dispersed in a polymeric binder.

2. The assemblage of claim 1 wherein said acidic salt has the formula:

$$(B^1H^+)_nY^{-n}$$

wherein:

$B^1H^+$ represents the protonated form of a basic, nitrogen-containing moiety ($B^1$) having an aqueous pKa of from about 0 to 10;

$Y^{-n}$ represents the mono- or polyvalent conjugate anion of a strong organic or inorganic protic acid;

n represents an integer from 1 to 3, and when n is greater than 1, each $B^1H^+$ may be the same or different;

$B^1$ and Y may be separate or joined together; and either or both of $B^1$ and Y may be joined to a polymeric chain.

3. The assemblage of claim 1 wherein said deprotonated, delocalized cationic dye precursor has the following formula:

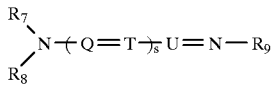

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

4. The assemblage of claim 1 wherein said cationic dye precursor has the following formula:

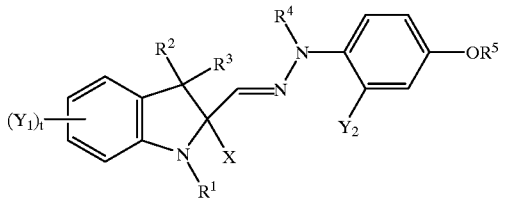

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

5. A process of forming a dye transfer image comprising imagewise-heating a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-$(L\text{-}E)_m$ wherein D represents the residue of a dye, L represents a linking group, E represents a moiety with basic properties and m is an integer of 1–3; or III) a cationic dye precursor having the following structure:

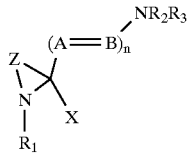

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring;

and imagewise transferring said dye to a dye-receiving element to form said dye transfer image, said dye-receiving element comprising a support having thereon a polymeric dye image-receiving layer, said polymeric dye image-receiving layer comprising an acidic salt formed from the reaction of a weak, nitrogen-containing base with a strong protic acid dissolved or dispersed in a polymeric binder.

6. The process of claim 5 wherein said acidic salt has the formula:

$$(B^1H^+)_nY^{-n}$$

wherein:

$B^1H^+$ represents the protonated form of a basic, nitrogen-containing moiety ($B^1$) having an aqueous pKa of from about 0 to 10;

$Y^{-n}$ represents the mono- or polyvalent conjugate anion of a strong organic or inorganic protic acid;

n represents an integer from 1 to 3, and when n is greater than 1, each $B^1H^+$ may be the same or different;

$B^1$ and Y may be separate or joined together; and either or both of $B^1$ and Y may be joined to a polymeric chain.

7. The process of claim 5 wherein said deprotonated, delocalized cationic dye precursor has the following formula:

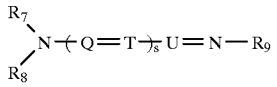

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

8. The process of claim 5 wherein said cationic dye precursor has the following formula:

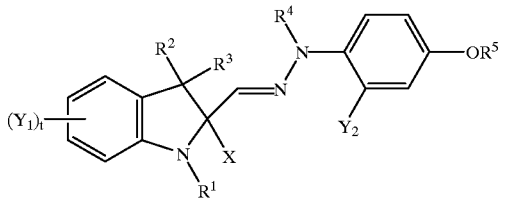

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

* * * * *